US006945429B2

(12) United States Patent
Gosis et al.

(10) Patent No.: US 6,945,429 B2
(45) Date of Patent: Sep. 20, 2005

(54) DISPOSABLE PAINT CUP ATTACHMENT SYSTEM FOR GRAVITY-FEED PAINT SPRAYER

(75) Inventors: Anatoly Gosis, Palatine, IL (US); Mark D. Bauer, Mount Prospect, IL (US); Marvin D. Burns, Millbury, OH (US); Mark E. Charpie, Lambertville, MI (US); Robert G. Kobetsky, Chicago, IL (US); Michael J. Kosmyna, Toledo, OH (US); Jan Toczycki, Chicago, IL (US); G. Michael Velan, Mount Prospect, IL (US)

(73) Assignee: Illinois Tool Works Inc., Glenview, IL (US)

( * ) Notice: Subject to any disclaimer, the term of this patent is extended or adjusted under 35 U.S.C. 154(b) by 120 days.

(21) Appl. No.: 10/458,478

(22) Filed: Jun. 10, 2003

(65) Prior Publication Data

US 2004/0251269 A1 Dec. 16, 2004

(51) Int. Cl.[7] ..... B05B 7/30

(52) U.S. Cl. ..... 222/105; 222/183; 222/541.1; 222/482; 222/386.5; 239/302; 239/320; 239/323; 239/DIG. 14; 141/330

(58) Field of Search ..... 239/302, 320, 239/323, 328, DIG. 14; 222/105, 183, 386.5, 479, 482, 541.1; 141/330

(56) References Cited

U.S. PATENT DOCUMENTS

| | | | | |
|---|---|---|---|---|
| 4,151,929 | A | | 5/1979 | Sapien |
| 4,886,212 | A | * | 12/1989 | Proctor et al. ..... 239/315 |
| 5,242,085 | A | | 9/1993 | Richter et al. |
| 5,301,838 | A | | 4/1994 | Schmidt et al. |
| 5,332,121 | A | | 7/1994 | Schmidt et al. |
| 5,582,350 | A | | 12/1996 | Kosmyna et al. |
| 5,816,501 | A | | 10/1998 | LoPresti et al. |
| 6,276,558 | B1 | | 8/2001 | Kneer |
| 2002/0134861 | A1 | | 9/2002 | Petrie et al. |
| 2003/0006311 | A1 | | 1/2003 | Rothrum et al. |

FOREIGN PATENT DOCUMENTS

WO 02/072276 A1 9/2002

* cited by examiner

*Primary Examiner*—J. Casimer Jacyna
(74) *Attorney, Agent, or Firm*—Lisa M. Soltis; Mark W. Croll; Richard P. Beem

(57) ABSTRACT

A novel fluid supply cup comprises a flexible liner integral with a container having an opening and a vent. A novel method of manufacturing a lined container comprises the steps of molding a container having a vented thick-walled portion and an integral flexible thin-walled liner, and folding the thin-walled liner into the thick-walled portion. Finally, a novel method of applying a fluid comprises the steps of providing a flexible liner integral with a container having an opening and a vent, loading fluid into the liner, engaging the container with a fluid applicator, flowing the fluid out of the liner into the fluid applicator, collapsing the liner, and flowing the fluid of the fluid applicator.

14 Claims, 3 Drawing Sheets

10b
12b
20b
22
14b
18
1
16
42b
40b 10
12
20
22
14
18
16
1
42
40

10
14
12
20
22
18
16
1
42
40

10
12
14
46
18
42b
22b
1
40
45
44

20
10
12
56
14
18
16
30
1
52
40
54

DISPOSABLE PAINT CUP ATTACHMENT SYSTEM FOR GRAVITY-FEED PAINT SPRAYER

BACKGROUND OF THE INVENTION

1. Field of the Invention

The present invention is directed to a fluid supply cup for a fluid applicator, more particularly to a paint supply cup for a paint sprayer.

2. Description of the Related Art

Fluid is typically delivered to fluid applicators, such as paint sprayers, in one of three ways. For large applications which do not require frequent fluid change, the fluid may be fed through a hose connected to a remote pressurized source. For smaller applications, such as automobile painting and repainting in body shops, the fluid is generally placed in a cup attached to the sprayer. Commonly, the cup is suspended below a front end of a body on the sprayer and the fluid is fed to a nozzle by suction or aspiration induced by atomization air flow through the sprayer. This type of sprayer is commonly referred to as a suction feed sprayer. For viscous fluids and for sprayers operating at low air pressures, the cup may be pressurized to increase the fluid application rate. Finally, a cup is sometimes mounted above the sprayer body to feed the fluid via gravity to the sprayer so that less air pressure is needed to aspirate the paint, usually referred to as a gravity feed sprayer.

For supply-cup types of sprayers, it is important that the supply cup and sprayer be free from contamination, especially in painting applications, wherein it is particularly important to avoid contamination between batches so that the desired paint color is achieved for each batch.

Disposable cups and liners have been developed to avoid contamination between batches and to minimize the amount of cleaning needed between applications.

U.S. Pat. No. 5,816,501 to LoPresti et al. teaches a disposable collapsible liner for a suction feed sprayer, wherein the liner is within a paint jar and paint is drawn through a feed tube. However, the liner is subject to being drawn into the tube opening via suction, which can block the flow of paint through the tube.

U.S. Pat. No. 5,582,350 to Kosmyna et al. teaches a non-disposable gravity feed paint cup with a disposable liner. The liner requires the installation of a port with a special tool and takes considerable time and effort. Further, the liner is hard to remove without spilling paint into the paint cup, which requires cleaning of the cup.

U.S. Published Applications U.S. 2003/0006311 and U.S. 2002/0134861 and International Published Application WO 02/072276 teach gravity feed paint cup assemblies with disposable liners. However, these applications require the assembly of several parts by the operator to ensure the paint cup is sealed, taking up valuable time. Additionally, the assembly is made of several injection molded pieces which are relatively expensive, especially if the parts are disposable instead of being reused.

What is needed is a disposable fluid supply cup that is easy to assemble by an operator, and that can be disposable without being overly expensive.

SUMMARY OF THE INVENTION

In accordance with the present invention, a novel fluid supply cup comprises a flexible liner integral with a container having an opening and a vent.

Also in accordance with the present invention, a novel method of manufacturing a lined container includes the steps of molding a container having a vented thick-walled portion and an integral flexible thin-walled liner, and folding the thin-walled liner into the thick-walled portion.

Also in accordance with the present invention, an improved method of applying a fluid comprises the steps of providing a flexible liner integral with a container having an opening and a vent, loading fluid into the liner, engaging the container with a fluid applicator, flowing the fluid out of the liner and into the fluid applicator, collapsing the liner, and flowing the fluid out of the fluid applicator.

In one embodiment of the method of applying a fluid, the fluid applicator is a sprayer, and the flowing step comprises spraying the fluid out of the sprayer.

DETAILED DESCRIPTION OF THE INVENTION

Figure 1:
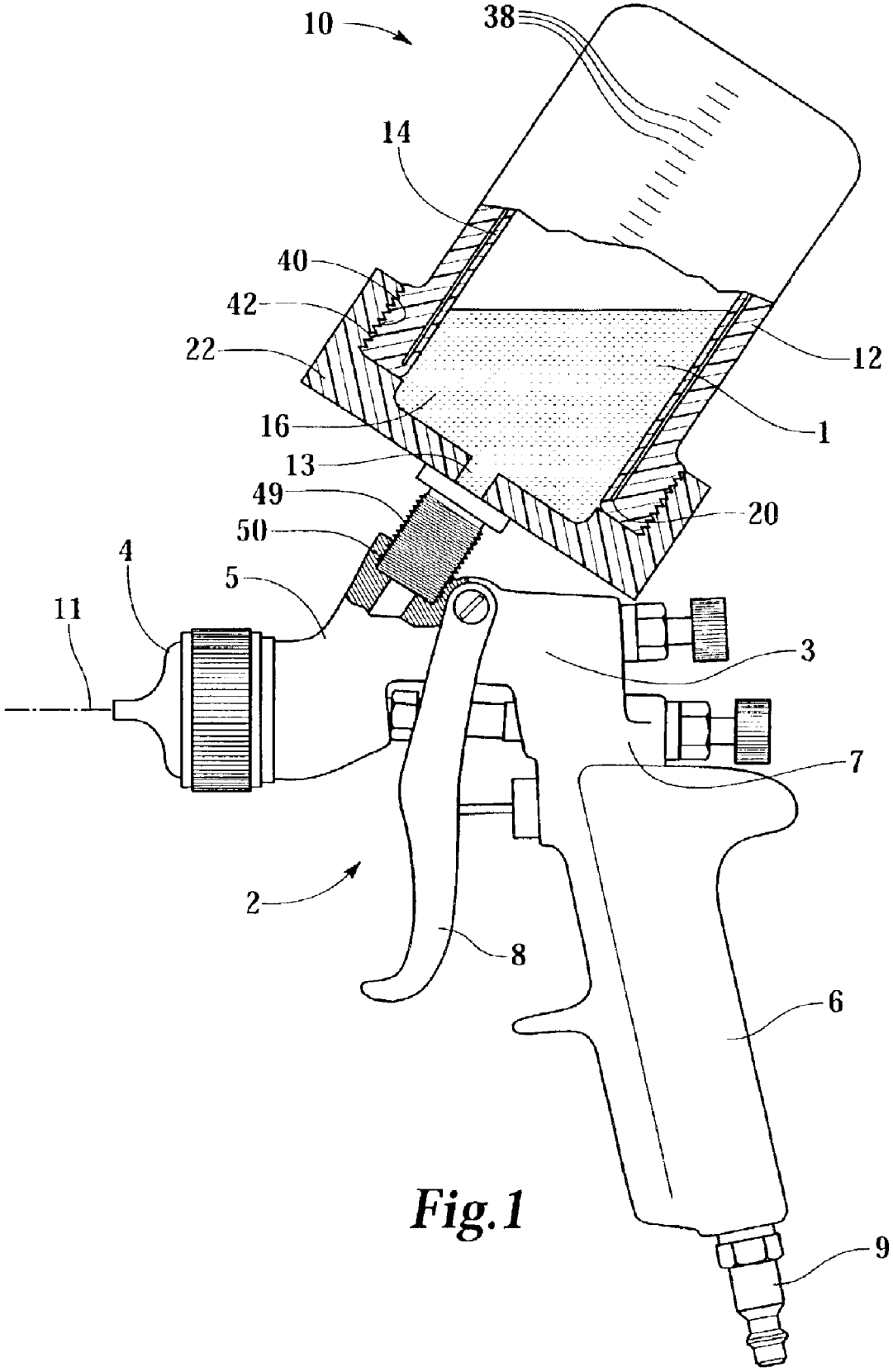
FIG. 1 is a side elevation view of a gravity feed paint sprayer with a novel fluid supply cup according to the present invention having a container with an integral liner.

Referring to FIG. 1, a fluid supply cup 10 is shown for feeding fluid to a fluid applicator 2. The novel fluid supply cup 10 includes a flexible liner 14 integral with a container 12 having an opening 16 (best shown in FIG. 2) and a vent 18. In one embodiment, fluid supply cup 10 is for feeding fluid to a sprayer. In a preferred embodiment, fluid supply cup 10 is a paint cup for feeding paint to a paint sprayer 2; therefore the present invention will be described for a paint sprayer, such as a gravity feed paint sprayer for use in applying paint 1 to coat substrate surfaces. In one embodiment, paint sprayer 2 is used in the automotive refinishing market, such as automobile body shops, for repainting automobiles. Paint cup 10 of the present invention is easy for an operator to install and is inexpensive to manufacture, saving the operators both time and money.

Although fluid supply cup 10 is described herein as a paint cup, it alternatively can be used for supplying other flowable fluids, such as beverages, foods, or condiments, for example ketchup, gasoline, petrochemicals and hydrocarbons, water, water-based solutions, solvent-based solutions, emulsions, and adhesives. The fluid being supplied must be compatible with fluid supply cup 10 and should be applied in a similar manner as paint from paint cup 10.

A paint sprayer 2 is shown in FIG. 1 and includes a body 3, a nozzle assembly 4 secured to a front end 5 of body 3, and a handle 6 depending from a rear end 7 of body 3. A trigger 8 is pivotally secured to body 3 for the manual actuation of sprayer 2. A top mounted, gravity feed paint cup 10 is mounted to body 3 via an adapter 22 near front end 5 for feeding paint to nozzle assembly 4. An air connector 9 is connected to an air hose (not shown) for the delivery of pressurized air to nozzle assembly 4, wherein the delivery of pressurized air is controlled by trigger 8.

Compressed air from connector 9 is delivered through an internal passage (not shown) to nozzle assembly 4 and the compressed air acts to atomize paint and deliver it through nozzle assembly 4 to spray paint 1 about a spray axis 11. Paint 1 is delivered to nozzle assembly 4 via gravity from paint cup 10. The level of paint 1 in paint cup 10 must be higher than the sprayer connection channel 13, or else paint 1 will not feed via gravity to the nozzle assembly 4, a condition known as starvation.

Figure 2:
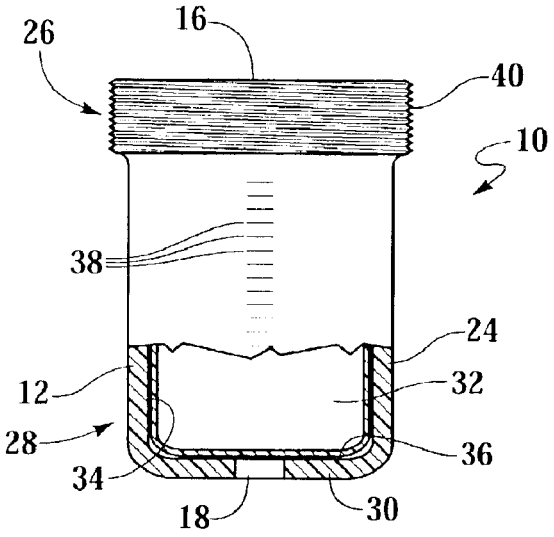
FIG. 2 is a side-sectional view of the fluid supply cup of the present invention.

Turning to FIGS. 1 and 2, the novel and improved paint cup 10 of the present invention provides an inexpensive, easy to use disposable container for the delivery of paint 1 to sprayer 2. Novel paint cup 10 includes a container 12 having an opening 16, best seen in FIG. 2, a vent 18, and a flexible liner 14 integral with container 12. In one embodiment, shown in FIG. 1, liner 14 is integrally formed with container 12 at joint 20 near opening 16. Paint 1 is loaded into liner 14 and container 12 is engaged with sprayer 2 so that the paint 1 can be fed to nozzle assembly 4.

Figure 9:
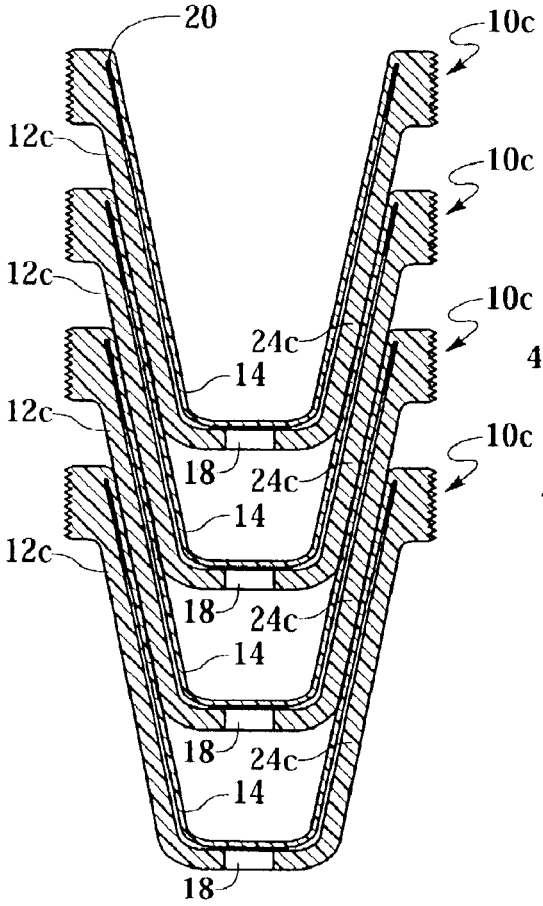
FIG. 9 is a side sectional view of an alternative embodiment of the present invention, wherein the walls of the fluid supply cup are slanted to permit stacking.

In one embodiment, best seen in FIG. 2, container 12 includes a generally cylindrical side wall 24 having a generally open first end 26 defining opening 16 into container 12 and a base wall 30 at a second end 28, wherein side wall 24 and base wall 30 surround an interior 32 of container 12. Side wall 24 includes a side interior surface 34 and base wall 30 includes a base interior surface 36. In one embodiment, vent 18 is included generally at second end 28, such as in base wall 30, shown in FIG. 2. Vent 18 allows air to flow into the interior 32 of container 12, providing vacuum relief so that liner 14 may collapse (described below). In one embodiment, side wall 24*c* of container 12*c* is generally frusto-conical in shape so that side wall 24*c* is slanted slightly, as shown in FIG. 9, so that a plurality of paint cups 10*c* can be stacked for easy storage and dispensation.

The walls of container 12, such as walls 24 and 30, are relatively thick in relation to flexible liner 14. Walls 24, 30 should be thick enough so that container is generally stiff and rigid and will not easily collapse. In one embodiment, the thickness of walls 24, 30 is between about 0.02 inches and about 0.06 inches, preferably about 0.025 inches. The thickness of walls 24, 30 may be dependent on the material of construction of container 12.

Side wall 24 can include graduations 38 indicating the level of paint 1 in paint cup 10. Graduations 38 can act as proportional indicators to indicate the levels of one or more fluids that should be added to paint cup 10 to provide a predetermined ratio between the liquids. For example, a certain amount of a base paint color can be mixed with tinting additives at a predetermined ratio to match a desired color for an automobile.

Container 12 also includes a means for connection to sprayer 2. In one embodiment, shown in FIG. 4, the means for connection is threading 40 at first end 26 which engages directly with adapter 22 via adapter threading 42 so that paint cup 10 is releasably engageable with sprayer 2. The means for connection could also be a bayonet connection (not shown), or a snap engagement (not shown) between container 12 and adapter 22. Alternatively, the connection between container 12 and adapter 22*b* can be via a lid 44, see FIG. 8, wherein container 12 can be connected to lid 44 with threading 40 engaging with lid threading 45, and lid 44 can be connected to adapter 22*b* via threading 46.

Container 12 can engage with lid 44 and lid 44 can engage with adapter 22*b* by other connection means than a threaded connection, such as a bayonet connection, a snap engagement, or a self-locking taper engagement between the inlet connection and the container (not shown). Novel self-locking tapered connections are described in more detail in the commonly assigned, co-pending patent application filed contemporaneously herewith, the disclosure of which is incorporated herein by reference.

Figure 10:
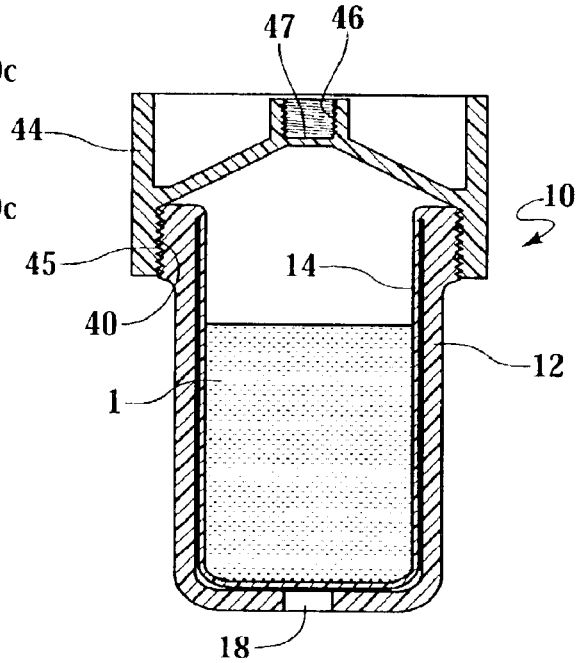
FIG. 10 is a side section view of the fluid supply cup with the lid for engaging with an adapter, wherein the adapter has not been engaged with the lid.

In one embodiment, lid 44 keeps paint cup 10 sealed until lid 44 is engaged with adapter 22. In this embodiment, shown in FIG. 10, lid 44 includes a perforable membrane 47 which is broken when adapter 22 is engaged with lid 44, shown in FIG. 8. After container 12 has been engaged with lid 44, paint 1 is sealed within paint cup 10 because air, water vapor, and other materials cannot pass through membrane 47.

It is important that the means for connection create a tight hermetic seal between container 12 and adapter 22 or between container 12 and lid 44 and between lid 44 and adapter 22 so that paint cup 10 is water tight and air tight during operation of sprayer 2 to prevent the escape of solvents, causing premature drying of paint 1 and the formation of a skin layer. Also, water can degrade the quality of paint 1, causing contamination or discoloration of the paint.

In one embodiment, container 12 can have an interior volume of between about 8 fluid ounces and about 2.5 gallons, preferably between about 16 fluid ounces and about one liter. A one liter generally cylindrical container 12 has a length of about 4 inches and a diameter of about 6 inches. However, container 12 can have different proportions or geometry. Preferably, the size and shape of container 12 is conducive to the automobile refinishing industry so that sprayer 2 and paint cup 10 are not unwieldy or overly heavy for an operator to handle.

Preferably, container 12 is made from a translucent material so that the level of paint 1 can be seen through container 12. Container 12 should also be relatively durable and resistant to collapsing, be made from a relatively inexpensive material and be inexpensive to manufacture so that container 12 can be disposable, and be made from a material that is substantially unreactive, preferably unreactive to the fluid in fluid supply cup 10. In one embodiment, container 12 is made from a molded plastic, such as polyethylene or polypropylene. In a preferred embodiment, container 12 is molded from low-density polyethylene.

Figures 4, 5, 6, 7, 8:
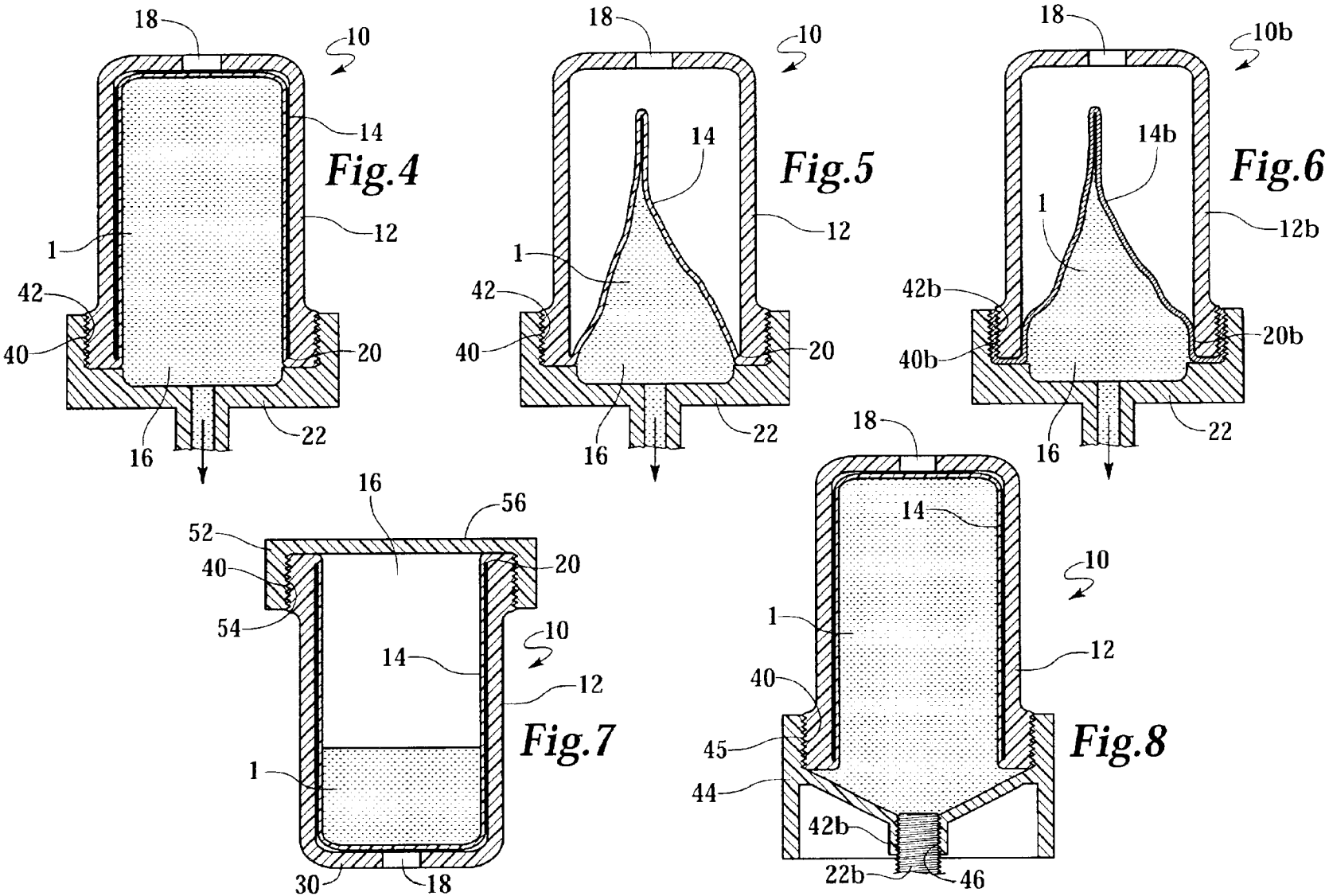
FIG. 4 is a side sectional view of the fluid supply cup before paint is flowing into the paint sprayer.
FIG. 5 is a side sectional view of the fluid supply cup wherein the liner is collapsing as paint is flowing into the paint sprayer.
FIG. 6 is a side section view of an alternative embodiment of the present invention, wherein the liner is adhered to the container.
FIG. 7 is a side sectional view of the fluid supply cup with a storage lid.
FIG. 8 is a side sectional view of the fluid supply cup with a lid for engaging with an adapter of the paint sprayer.

Turning to FIG. 5, flexible liner 14 is located within interior 32 of container 12. Liner 14 is thin and flexible so that it is capable of collapsing as paint 1 flows out of paint cup 10 and into sprayer 2 while still preventing the inflow of air into liner 14. As paint 1 flows out of liner 14 a partial vacuum is formed within liner 14 due to fluid displacement. Because liner 14 is flexible and vent 18 allows air to flow into interior 32 of container, atmospheric pressure offsets the vacuum formed in liner 14, and causes liner 14 to collapse, as shown in FIG. 5.

The thickness of liner 14 is relatively thinner than the thickness of walls 24, 30 of container 12. Liner 14 should be thin enough so that it is flexible, softer than container 12, pliable, and insertable into interior 32 of container 12. In one embodiment, the thickness of liner 14 is between about 0.004 inches and about 0.015 inches, and preferably between about 0.005 inches and about 0.01 inches.

Figure 3:
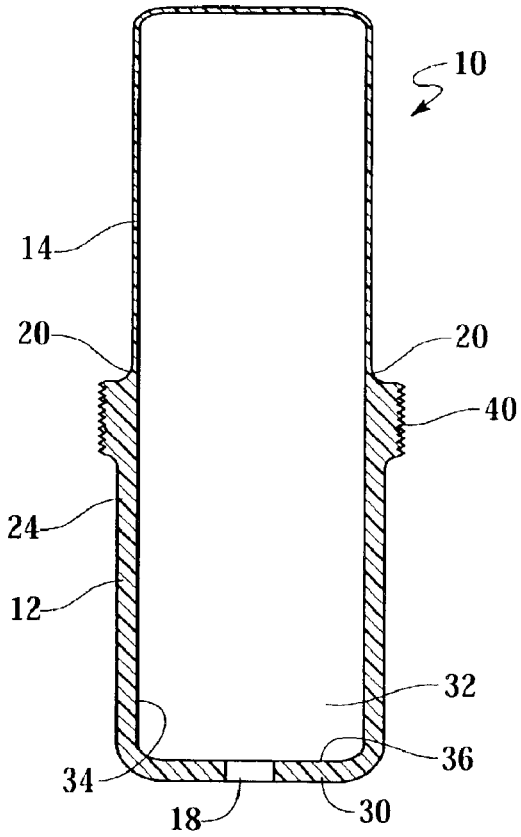
FIG. 3 is a side-sectional view of the fluid supply cup before the integral liner has been folded into the container.

Flexible liner 14 is integral with container 12. In one embodiment, liner 14 is integrally molded with container 12 so that they are formed continuously, best shown in FIG. 3, such as by injection blow molding flexible Liner 14 and container 12 in the same process as described below. Preferably, Liner 14 is integral with container 12 at joint 20 at first end 26 around opening 16, as shown in FIGS. 2 and 3, so that liner 14 will be easily invertable into interior 32 of container 12.

In another embodiment, shown in FIG. 6, liner 14*b* and container 12*b* are molded or formed separately and adhered to each other to form paint cup 10*b*. Liner 14*b* can be adhered or attached to container 12*b* via, for example, adhesives, plastic weldment, sonic weldment, molecular diffusion, or other methods of fusing plastic. Preferably, liner 14*b* is adhered to container 12*b* at joint 20*b* near opening 16*b*. In one embodiment, shown in FIG. 6, liner 14*b* includes a portion 48 that extends past opening 16*b* to cover threading 40*b* so that when container 12*b* is threadingly engaged with adapter 22, so that portion 48 of liner 14*b* will act as an extra seal between container 12*b* and adapter 22 to prevent leakage of paint 1.

In a preferred embodiment, shown in FIG. 2, liner 14 substantially conforms to interior surfaces 34, 36 of container 12 when liner 14 is not collapsed, still more preferably so that there is full geometric conformity between interior surfaces 34, 36 and liner 14. Conformity of liner 14 preferred so that the level of paint 1 in liner 14 can most accurately be measured with graduations 38. Accurate indication of fluid level is particularly important during mixing of multiple fluids in predetermined ratios.

As with container 12, flexible liner 14 is preferably made from a translucent material so that the paint level can be seen. Liner should also be made from a material that can be pliable and foldable, and that is unreactive with the fluid in fluid supply cup 10. Further, the material of liner 14 should be inexpensive, and liner 14 should be inexpensive to manufacture. In one embodiment, liner 14 is made from a moldable plastic, such as polyethylene or polypropylene. In a preferred embodiment, liner 14 is molded from low density polyethylene.

Advantageously, in order to connect paint cup 10 with sprayer 2, the operator simply has to engage container 12 with adapter 22, or with lid 44 and then engage lid 44 with adapter 22*b* as in FIG. 8, which requires very little time or effort on the part of the operator. The easy assembly of paint cup 10 offers a significant savings of time and effort on the part of operators over traditional paint cups, which require significant assembly of several complicated parts. Further, paint cup 10 is inexpensive to manufacture so that it can be disposable without being overly expensive.

Returning to FIG. 1, adapter 22 provides a connection between paint cup 10 and sprayer 2 and provides a path for paint 1 to flow from paint cup 10 into sprayer body 3. Adapter 22 can engage directly with container 12 at opening 16, such as between container threading 40 and adapter threading 42, or adapter 22 can engage with a lid 44. Preferably, adapter 22 is a mass produced machined adapter and the connection between adapter 22 and sprayer body 3 is a conventional connection, such as threaded engagement between threading 49 on adapter 22 and sprayer threading 50, so that adapter may be releasably connected to several sprayers 2. In one embodiment, adapter also includes a filter (not shown) to filter impurities, such as dust or other particulates, from flowing into sprayer 2 so that the impurities will not be applied to the surface being painted.

Although adapter 22 is shown as being one piece, it is envisioned that adapter 22 can have other configurations, such as an adjustable adapter that allows the orientation of container 12 to be changed to ensure that paint 1 will flow into sprayer 2. A novel adjustable adapter is disclosed in the commonly assigned, co-pending patent application filed contemporaneously herewith, the disclosure of which is incorporated herein by reference.

Turning to FIG. 7, in another embodiment a storage lid 52 is provided for covering paint cup 10 when painting is completed or temporarily stopped. The exact amount of paint 1 required may not be easy to determine, and there is frequently left over paint 1. In some cases, it may be desirable to store a particular color of paint 1 for later use, such as for touch-ups of a popular automotive paint color. Storage lid 52 includes a means for connection to container, such as storage lid threading 54 that engages with container threading 40, to cover opening 16 and provide a tight, hermetic seal with paint cup 10, so that left over paint 1 can be stored easily. Some paints 1 have a shelf life of up to about 3 days or more. Preferably, the top 56 of storage lid 52 generally complements the base wall 30 of container 12 so that multiple covered paint cups 10 can be stacked.

Alternatively, after application of paint 1, it may be desirable to discard left-over paint while preventing spillage of paint 1 from paint cups 10. Because some paints include solvents or other components that are undesirable to allow to spill, the tight seal between container 12 and storage lid 52 allows for sanitary disposal of left-over paint 1.

New and improved paint cup 10 is made by a novel method including the steps of molding a container, such as paint cup 10 shown in FIG. 2, having a vented thick-walled portion and an integral flexible thin-walled liner, and folding the thin-walled liner into the thick-walled portion. In one embodiment, shown in FIG. 2, the thick-walled portion is container 12 and the thin-walled liner is flexible liner 14.

Molding of liner 14 and container 12 are preferably done by a process wherein liner 14 and container 12 are integrally formed so that liner 14 and container 12 are molded as a single piece. In one method, the molding process forms a generally closed container, such as the generally closed cylinder shown in FIG. 3, wherein the thickness of the walls of the cylinder abruptly diminishes along the length of the cylinder between thin-walled liner 14 and thick-walled container 12.

In one method, molding of liner 14 and container 12 comprises a two-step injection blow molding process. The two-step process requires precision control of a parison used to mold both liner 14 and container 12. Liner 14 injection molded in a first step at a relatively low pressure, wherein the temperature, pressure, and other molding conditions should be tightly controlled. After injection blow molding of liner 14, the pressure is increased to a relatively high pressure, to injection blow mold container 12.

Injection blow molding of liner 14 and container 12 is accomplished through a blow hole formed at the base of container 12. In a preferred embodiment of container 12, hole 18 acts as the blow hole during the molding process. The same hole 18 can be used to vent air into the interior 32 of container 12 during subsequent use of paint cup 10.

Liner 14 and container 12 can be molded by other means, such as injection molding, rotational molding, suction molding, or extrusion molding. Injection blow molding is preferred because it is an inexpensive process. Alternatively, molding of liner 14 and container 12 can be separate and liner and container 12 can be made integral by adhering liner 14 to container.

After liner 14 and container 12 have been molded and are integral with each other, as in FIG. 3, liner 14 is folded into container 12 to form a lined paint cup 10, shown in FIG. 2. Folding of liner 14 into container 12 can be done mechanically, such as by air pressure, applied to liner 14 to force it into the interior 32 of container 12, or by forming a partial vacuum in interior 32 of container 12 so that liner 14 is drawn into container 12. In a preferred method, liner 14 is mechanically inserted into container 12 with assistance from a partial vacuum formed in interior 32 through vent 18.

Preferably, folding liner 14 in container 12 includes substantially conforming liner 14 to interior surfaces 34, 36 of container 12. In one method, conforming liner 14 to surfaces 34, 36 is accomplished by applying air pressure to liner 14 so that there is full geometric conformity between liner 14 and interior surfaces 34, 36.

A novel method of applying a fluid comprises the steps of providing a flexible liner 14 integral with a container 12 having an opening 16 and a vent 18, loading fluid, such as paint 1, into liner 14, engaging container 12 with a fluid applicator, flowing the fluid out of liner 14 and into the fluid applicator 2, collapsing liner 14, and flowing the fluid out of the fluid applicator.

In one method, the flowing step comprises spraying the fluid out of sprayer 2 and in another method, sprayer 2 is a paint sprayer for spraying paint 1 onto a surface, such as the body of an automobile.

The loading step includes loading paint into paint cup 10. The loading step can also comprise loading paint into liner 14 followed by loading a second fluid, such as another paint, tinting additives, or solvents, in predetermined ratios to create paint having a desired color.

The step of engaging container 12 with sprayer 2 can be accomplished by engaging container 12 directly with an adapter 22 connected to sprayer 2, shown in FIGS. 1 and 4, or by engaging container 12 with a lid 44 followed by engaging lid 44 with adapter 22*b*, as shown in FIG. 8.

The collapsing step includes collapsing liner 14 due to a partial vacuum formed as paint 1 is drawn out of liner 14 and into sprayer 2.

The inventive method can also include the step of covering container 12 with a storage lid 52 for the storage or disposal of left-over paint 1 in paint cup 10.

The present invention provides an inexpensive and disposable fluid supply cup that requires little assembly on the part of an operator and that can be easily stored and disposed. The novel fluid supply cup comprises a flexible liner integral with a container having an opening and a vent. A novel method of manufacturing a lined fluid supply container comprises the steps of molding a container having a vented thick-walled portion and an integral thin-walled liner, and folding the thin-walled liner into the thick walled portion. Also, a novel method of applying a fluid is provided comprising the steps of providing a flexible liner integral with a container having an opening and a vent, loading fluid into the liner, engaging the container with a fluid applicator, flowing the fluid out of the liner and into the fluid applicator, collapsing the liner, and flowing the fluid out of the fluid applicator.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention.

What is claimed is:

1. A fluid supply cup comprising a flexible liner of a first thickness integral with a generally rigid, non-collapsible container of a second thickness greater than said first thickness and having an opening and a vent, wherein said liner is integrally molded with container so that they are formed continuously in the same process, and wherein said liner is joined with said container around an area defining an opening at a first end, when said liner is inverted into said container.

2. A fluid supply cup according to claim 1, wherein said container further comprises an interior surface, wherein said flexible liner is conformable to said interior surface.

3. A fluid supply cup according to claim 1, wherein said container further comprises slanted side walls for stacking.

4. A fluid supply cup according to claim 1, wherein said container is engageable with a fluid applicator.

5. A fluid supply cup according to claim 1, further comprising a lid for covering said container.

6. A fluid supply cup according to claim 5, wherein said lid includes a perforable membrane.

7. A fluid supply cup according to claim 1, wherein said container includes a generally cylindrical side wall having a generally open first end and a base wall at a second end, wherein said base wall has a vent to allow air to flow into an interior of said container, providing vacuum relief so that said liner may collapse as fluid flows out of said liner.

8. A fluid supply cup according to claim 1, wherein said side wall and said base wall have a thickness of between about 0.02 inches and about 0.06 inches.

9. A fluid supply cup according to claim 1, wherein said side wall includes graduations indicating the level of paint.

10. A fluid supply cup according to claim 1, wherein said container includes means for connection to a sprayer.

11. A fluid supply cup according to claim 9, wherein said container includes a generally cylindrical side wall having a generally open first end, and wherein said means for connection is a threading at said first end which engages directly with an adapter.

12. A fluid supply cup according to claim 9, wherein said container includes a generally cylindrical side wall having a generally open first end, and wherein said means for connection is a threading at said first end which engages a lid, and wherein said lid is connected to an adapter.

13. A fluid supply cup according to claim 1, wherein said liner has a thickness of between about 0.004 inches and about 0.015 inches.

14. A fluid supply cup according to claim 1, wherein said container and said flexible liner are made from a translucent material.

* * * * *